US007153112B2

(12) United States Patent
Zarnoch et al.

(10) Patent No.: US 7,153,112 B2
(45) Date of Patent: Dec. 26, 2006

(54) COMPRESSOR AND A METHOD FOR COMPRESSING FLUID

(75) Inventors: Philip A. Zarnoch, Corning, NY (US); Michael A. Cary, Lockwood, NY (US); John A. Sawyer, Trout Run, PA (US)

(73) Assignee: Dresser-Rand Company, Olean, NY (US)

( * ) Notice: Subject to any disclaimer, the term of this patent is extended or adjusted under 35 U.S.C. 154(b) by 241 days.

(21) Appl. No.: 10/731,569

(22) Filed: Dec. 9, 2003

(65) Prior Publication Data

US 2005/0123429 A1 Jun. 9, 2005

(51) Int. Cl.
*F03C 2/00* (2006.01)
*F04C 18/00* (2006.01)

(52) U.S. Cl. ..... 418/195; 418/152; 418/153; 418/196

(58) Field of Classification Search ..... 418/195–197, 418/152, 189, 190, 153
See application file for complete search history.

(56) References Cited

U.S. PATENT DOCUMENTS

| | | | | | |
|---|---|---|---|---|---|
| 2,716,861 | A | * | 9/1955 | Goodyear | 418/195 |
| 2,745,355 | A | * | 5/1956 | Mosbacher | 418/153 |
| 3,133,695 | A | * | 5/1964 | Zimmern | 418/195 |
| 3,680,990 | A | | 8/1972 | Pettibone et al. | |
| 4,036,567 | A | * | 7/1977 | Sato | 418/195 |
| 4,037,998 | A | | 7/1977 | Goloff | |
| 4,063,939 | A | | 12/1977 | Weaver et al. | |
| 4,227,867 | A | * | 10/1980 | Whitehill et al. | 418/195 |
| 4,479,833 | A | | 10/1984 | Gessinger et al. | |
| 4,673,124 | A | | 6/1987 | Conolly | |
| 4,724,819 | A | | 2/1988 | Fleri | |
| 4,824,348 | A | * | 4/1989 | Winyard | 418/195 |
| 4,836,759 | A | | 6/1989 | Lloyd | |
| 4,846,642 | A | | 7/1989 | Nuber et al. | |
| 5,567,140 | A | | 10/1996 | Dodd | |
| 5,671,533 | A | | 9/1997 | Dillamore et al. | |
| 5,891,272 | A | | 4/1999 | Raymond et al. | |
| 5,902,546 | A | | 5/1999 | Kawasetsu et al. | |
| 6,094,815 | A | | 8/2000 | Shigihara et al. | |
| 6,494,171 | B1 | | 12/2002 | Duke | |

FOREIGN PATENT DOCUMENTS

JP 05113183 A * 5/1993

OTHER PUBLICATIONS

Internet Webpages for Gardner Denver Compressors, Quincy, Illinois, "Rotary Screw Compressors", Copyright Gardner Denver, 2002, 2 Pages.
Internet Webpages for Cashflo Limited, Norfolk, England, U.K., "The History of Screw Compressors", Undated, 2 Pages.

* cited by examiner

*Primary Examiner*—Theresa Trieu
(74) *Attorney, Agent, or Firm*—Michael Best & Friedrich LLP

(57) ABSTRACT

A compressor and a method for compressing fluid according to which a liner is disposed on the inner wall of a housing defining a bore. At least one slot and at least one discharge port are provided in the liner. A rotor is rotated in the housing with its outer surface in a closely spaced relation to the inner wall of the liner, and an additional rotor extends through the slot in the liner and intermeshes with the first rotor to compress fluid introduced between the rotors before it is discharged through the port.

32 Claims, 3 Drawing Sheets

COMPRESSOR AND A METHOD FOR COMPRESSING FLUID

BACKGROUND

This invention is directed to a compressor, such as a rotary screw compressor, for compressing a fluid, such as air.

Screw compressors use two or more intermeshing rotors, each provided with helical lobes to produce compression when the rotors are rotated. A fluid, such as air, is introduced into the compressor and is trapped between the rotors and compressed to the required discharge pressure.

However, these compressors are expensive to manufacture since they are provided with windows, slots, ports, passages, and the like, which are formed by fairly intricate castings and weldments. Also, when it is desired to change the operating parameters of the compressor, such as its discharge pressure, flow rate, and capacity, the housing has to be replaced with a new cast housing having a different arrangement of windows, slots, ports, passages, and the like, which adds to the expense.

Therefore, what is needed is a compressor of the above type that eliminates, or at least reduces, these problems.

DETAILED DESCRIPTION

Figure 1:
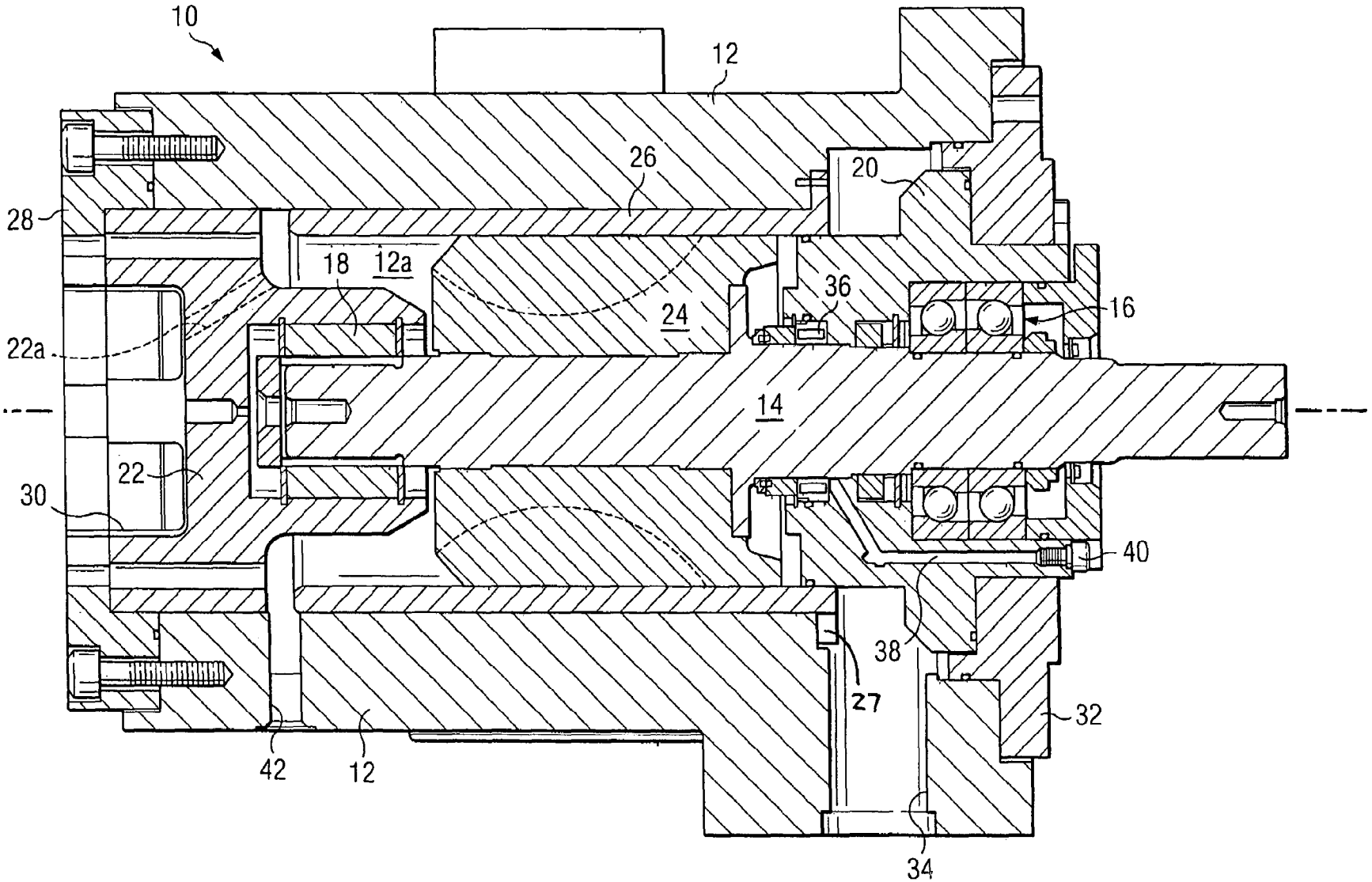
FIGS. 1 and 3 are sectional views of a screw compressor according to an embodiment of the invention.

Referring to FIG. 1 of the drawing, a screw compressor according to an embodiment of the invention is referred to, in general, by the reference numeral 10. The compressor 10 includes a housing 12, preferably formed of a forged billet and having a series of openings, bores, and chambers formed therein as will be described. A drive shaft 14 is supported in a longitudinal through bore 12*a* formed in the housing by a pair of axially spaced bearing assemblies 16 and 18 which are supported in the housing by two carriers 20 and 22, respectively, that are mounted in the bore. It is understood that the shaft 14 is connected to a driver, such as an electric motor, for rotating the shaft.

A rotor 24 is supported on the shaft 14 for rotation therewith, extends in the above bore 12*a*, and will be described in detail later. A cylindrical liner 26 is affixed to the inner surface of the housing 12 defining the bore 12*a*, and is very slightly spaced from the outer surface of the rotor 24. The rotor 24 and the liner 26 will be described in detail later.

A cover 28 is bolted over one end of the housing 12 and has a through opening in alignment with an opening formed in the carrier 22 to define an inlet 30 for a fluid, such as air, to be compressed. A passage 22*a* is formed in the carrier 22 that connects the inlet 30 to the bore 12*a*. A cover 32 extends over the other end of the housing 12 and has a through opening that receives a portion of the bearing 16. A radially extending discharge passage 34 is formed through the housing 12 for discharging the compressed fluid to external equipment.

A seal 36 extends adjacent the bearing 16 and around the shaft 14 to seal against the egress of the fluid from the bore 12*a*. One end of a drain passage 38 extends from the bore 12*a* near the seal 36, through the carrier 20, and is vented to a collection point. A radially extending drain connection 42 also extends from the bore 12*a* through the housing 12.

Figure 2:
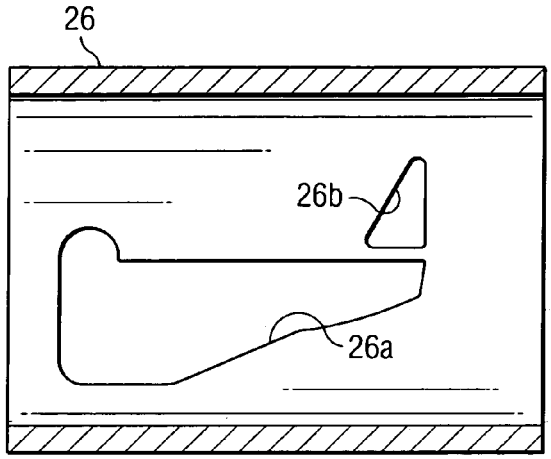
FIG. 2 is a sectional view of a component of the invention.

The liner 26 is shown in detail in FIG. 2 and includes an elongated, variable-width, slot 26*a* extending through a wall portion of the liner, along with a discharge port 26*b* in a slightly spaced relation to the slot. Although only one slot 26*a* and discharge port 26*b* are shown, it is understood that another slot 26*a* and discharge port 26*b* are formed through the liner 26 in a diametrically opposed relation to the slot 26*a* and discharge port 26*b* shown in FIG. 2. It is also understood that the discharge ports 26*b* are connected by internal passages 2 (one shown) in the housing 12 to the discharge passage 34. The liner 26 is interchangeable, e.g., it can be replaced by a different liner, it can be used to replace a different liner, or it can be added to a compressor that was initially designed without a liner.

Figure 3:
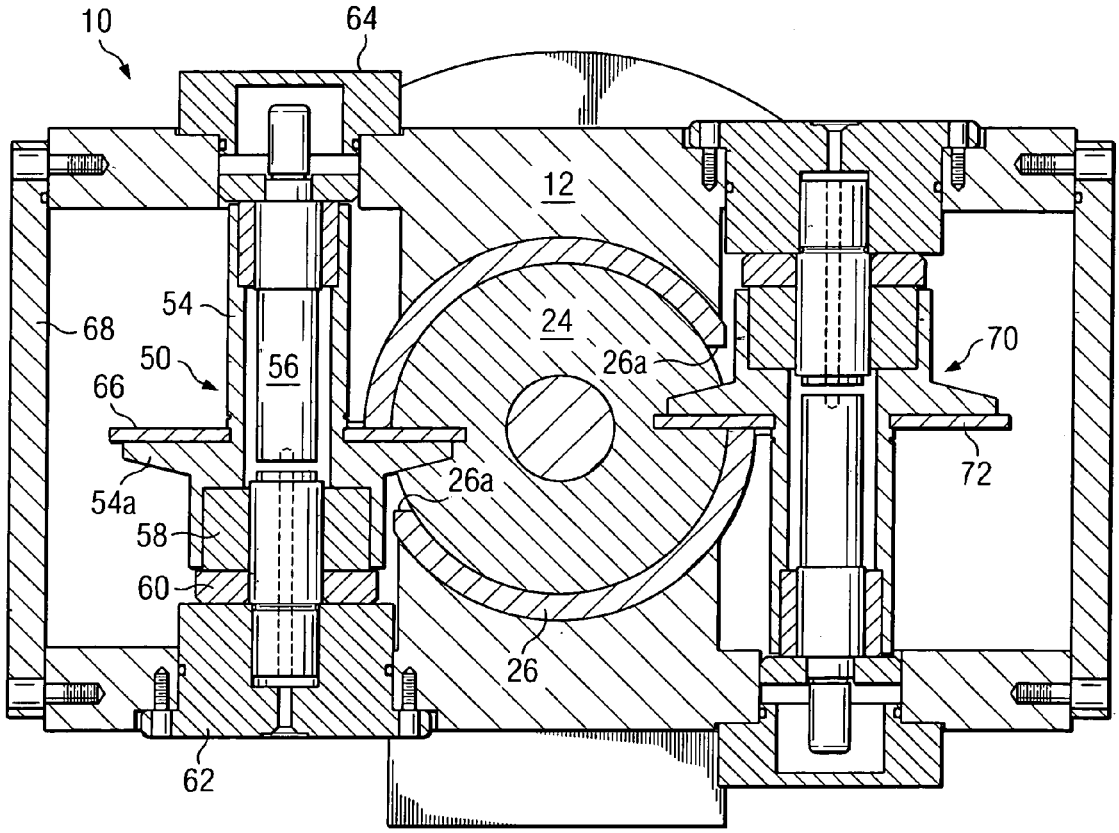

Referring to FIG. 3, a gate rotor assembly 50 is located in a chamber formed in the housing 12 to one side of the shaft 14 and the main rotor 24, with the axis of the assembly extending transverse to the axis of the rotor. The assembly 50 includes a cylindrical support 54 having an annular flange 54*a* extending therefrom. A shaft 56 extends through the support 54 and the lower end portion of the shaft 56, as viewed in FIG. 3, projects from the corresponding lower end of the support 54, through a thrust bearing 58 and a thrust washer 60, and into a cover 62 bolted to the housing 12. The other end portion of the shaft 56 projects from the upper end of the support 54 and extends into a cover 64 affixed to the housing 12, to permit rotation of the assembly 50 in the housing 12.

An annular gate rotor 66 is affixed to the upper surface of the flange 54*a*, and extends, with the flange, through one of the slots 26*a* formed through the liner 26, so as to mesh with the main rotor 24. Rotation of the main rotor 24 thus causes corresponding rotation of the gate rotor 66 for reasons to be described.

Another gate rotor assembly 70 is provided on the opposite side of the main rotor 24, is inverted when compared to the gate rotor assembly 50, and includes a rotor 72 which extends through the other slot 26*a* of the liner 26 and also meshes with the main rotor 24. Since the gate rotor 70 is identical to the gate rotor assembly 50, it will not be described in detail.

Figure 4:
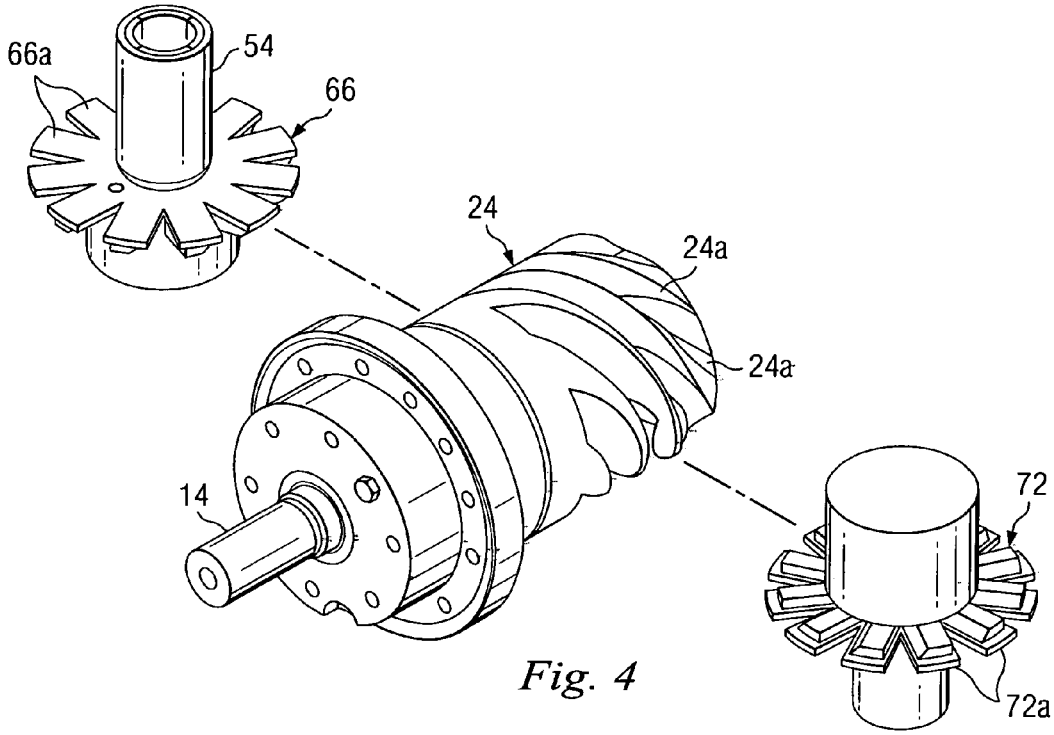
FIG. 4 is an exploded isometric view of some components of the compressor of FIGS. 1 and 2.

As shown in FIG. 4 the main rotor 24 has a plurality of lobes 24*a* which engage corresponding lobes 66*a* and 72*a* formed on the gate rotors 66 and 72, respectively, so that rotation of the rotor 24 causes a successive intermeshing with the lobes 24*a* and the lobes 66*a* and 72*a* and thus compresses fluid introduced between the lobes, in a manner to be described.

Figure 5A:
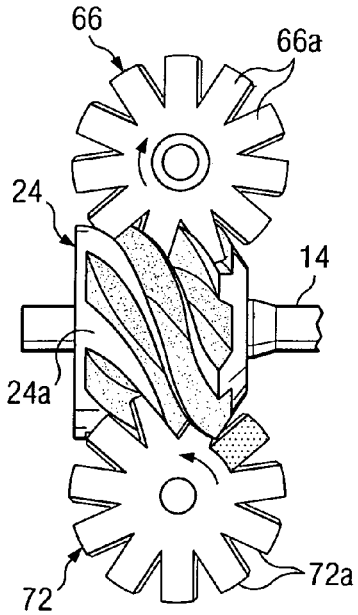
FIGS. 5A, 5B, and 5C are diagrammatic views depicting three operation modes of the compressor of FIGS. 1 and 3.
Figure 5B:
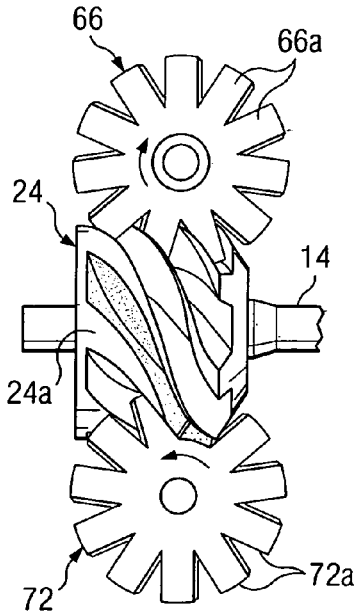
Figure 5C:
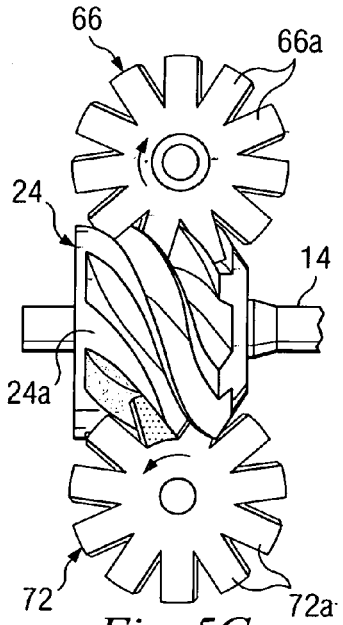

FIGS. 5A, 5B, and 5C depict the above compression in various stages of operation. In particular, the shaft 14, and therefore the rotor 24, is rotated, which causes corresponding rotation of the gate rotors 66 and 72. Fluid, such as air, enters the compressor 10 via the inlet 30 (FIG. 1) and passes though the passage 22*a*, into the bore 12*a* and through the slots 26*a* (FIGS. 1 and 2) in the liner 26. The fluid then fills the screw grooves defined by the lobes 24*a* of the main rotor 24, as shown in FIG. 5A. As the rotors 24, 66, and 72 rotate further, lobes 66*a* and 72*a* of the gate rotors 66 and 72, respectively, enter the latter screw grooves, trapping the air, and actual air compression begins, as shown in FIG. 5B. As the rotation continues, the trapped air is compressed as the length and the volume of each groove is reduced. When the main rotor 24 rotates far enough, each groove passes the discharge ports 26*b* (FIG. 2) of the liner 26, thus delivering the compressed air to the discharge passage 34, via the above-mentioned internal passages in the housing 12, for delivery to external equipment, such as a discharge manifold, or the like.

Also, since the shape and/or location of the slots 26*a* and the discharge ports 26*b* of the liner 26 dictate the operating parameters of the compressor, including its discharge pressure, flow rate, and capacity, these parameters can be changed by simply replacing the liner 26 with another liner having slots and/or discharge ports of a different shape and/or location. Thus, a compressor system could consist of the compressor 10, and two or more liners similar to the liner 26, with the location and size of the slots and/or discharge ports of each liner being designed for a particular different application of the system. Also, an existing compressor that does not have a liner can be fitted with a liner similar to the liner 26 with the slots and discharge ports being designed for the specific desired operating parameters.

As a result, there is provided a simple, easy, and cost-effective technique of varying the operating parameters of the compressor without having to resort to providing a relatively expensive new housing having formed windows, slots, ports, and passages formed therein to achieve the operating parameters. Even if only one liner is used, it also can be appreciated that the liner reduces the number and depth of the passages and ports that must be formed in the housing to achieve the desired flow characteristics.

Although not shown in the drawings, it is understood that the compressor 10 can be provided with a water injection system that supplies a continuous flow of cool filtered water to the compressor. This water is injected into the air stream as the air passes through the compressor 10 and is compressed in the above-described manner. The water mixes with the air and the mixture discharges from the compressor 10, via the discharge passage 34, to a separator (not shown) where the water is removed and collected. The pressure of the compressed air in the separator provides the force to circulate the water through the water injection system and inject it into the compressor 10.

It is understood that variations may be made in the foregoing without departing from the scope of the invention. For example, the invention is not limited to a screw compressor, but is equally applicable to any type of rotary machine having two intermeshing rotors. Also, any number of gate, or secondary, rotors that engage the main rotor can be utilized. Also spatial references, such as "upward", "downward", "vertical", etc., are for the purpose of illustration only and also do not limit the specific orientation or location of the structure described above.

Although only a few exemplary embodiments of this invention have been described in detail above, those skilled in the art will readily appreciate that many other modifications are possible in these embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures.

What is claimed is:

1. A compressor comprising;

a housing having a bore, a liner disposed on the inner wall of the housing defining the bore and having a wall portion and at least one slot and at least one discharge port each extending generally radially through the wall portion, a first rotor mounted for rotation in the housing having at least one groove for receiving fluid and being disposed within the liner such that an outer surface of the rotor is in a closely spaced relation to the inner surface of the liner, and at least one second rotor having a portion extending through the slot in the liner and intermeshing with the at least one groove of the first rotor so as to compress fluid introduced between the rotors and to direct the compressed fluid generally radially through the at least one discharge port in the liner wall portion.

2. The compressor of claim 1 further comprising a passage formed in the housing for receiving the discharged fluid from the port and passing it from the housing.

3. The compressor of claim 1 wherein the axis of the second rotor extends transverse to the axis of the first rotor.

4. The compressor of claim 1 wherein there are two second rotors disposed adjacent the respective sides of the first rotor.

5. The compressor of claim 1 wherein there are two diametrically opposed slots and two diametrically opposed ports formed through the liner.

6. The compressor of claims 1 wherein lobes are formed on the first rotor and define screw grooves for receiving the fluid.

7. The compressor of claim 6 wherein lobes are formed on the second rotor so that, as the first rotor rotates, the latter lobes enter the screw grooves to trap and compress the fluid.

8. The compressor of claim 7 wherein, as the first rotor rotates, the trapped fluid is compressed as the length and the volume of each screw groove is reduced.

9. The compressor of claim 8 wherein, upon further rotation of the first rotor, each groove passes the discharge port thus delivering the compressed fluid to the drain passage.

10. The compressor of claim 1 further comprising an additional liner having a slot and a discharge port at least one of which varies in location and/or size from the slot and discharge port of the first-mentioned liner so that the additional liner can be substituted for the first mentioned liner to change the operating characteristics of the compressor.

11. The compressor of claim 1 wherein the compressor is a screw compressor, the first rotor is a main rotor, and the second rotor is a gate rotor.

12. The compressor of claim 1 where the fluid is air.

13. A method for compressing fluid, the method comprising:

disposing a liner having a wall portion on the inner wall of a housing defining a bore, providing at least one slot and at least one discharge port in the liner such that the slot and discharge port extend generally radially through the liner wall portion, providing a first rotor with a groove for receiving fluid in the housing so as to be at least partially disposed within the liner such that an outer surface of the rotor is in a closely spaced relation to an inner surface of the liner, and providing at least one second rotor having a portion extending through the slot in the liner and intermeshing with the at least one groove of the first rotor so as to compress fluid introduced between the rotors and to direct the compressed fluid generally radially through the at least one discharge port.

14. The method of claim 13 further comprising forming a passage in the housing for receiving the discharged fluid from the port and passing it from the housing.

15. The method of claim 13 wherein the axis of the second rotor extends transverse to the axis of the first rotor.

16. The method of claim 13 wherein there are two second rotors disposed adjacent the respective sides of the first rotor.

17. The method of claim 13 wherein two diametrically opposed slots and two diametrically opposed ports are provided through the liner.

18. The method of claim 13 further comprising forming lobes on the first rotor that define screw grooves for receiving the fluid.

19. The method of claim 18 further comprising forming loves on the second rotor so that, as the first rotor rotates, the latter lobes enter the screw grooves to trap and compress the fluid.

20. The method of claim 19 wherein, as the first rotor rotates, the trapped fluid is compressed as the length and the volume of each screw groove is reduced.

21. The method of claim 20 wherein, upon further rotation of the first rotor, each groove passes the discharge port thus delivering the compressed fluid to the drain passage.

22. The method of claim 13 further comprising providing an additional liner having a slot and a discharge port at least one of which varies in location and/or size from the slot and discharge port of the first-mentioned liner, and substituting the additional liner for the first-mentioned liner to change the discharge pressure and/or flow rate of the fluid.

23. A method of varying the operating conditions of a compressor having a first rotor rotating in a housing and in engagement with a second rotor so as to compress fluid introduced between the rotors, the method comprising:

disposing a removable liner having a wall portion between the first rotor and the housing, providing a discharge port in the liner that extends generally radially through the liner wall portion to discharge the compressed fluid radially from the liner, and replacing the liner with another liner having a discharge port that varies in location and/or size form the port of the first-mentioned liner.

24. The method of claim 23 providing at least one slot in the liner for receiving at least a portion of the second rotor, the portion of the second rotor intermeshing with the first rotor.

25. The method of claim 24 wherein the other liner has a slot that varies in location and/or size from the slot of the first-mentioned liner.

26. The method of claim 25 wherein the step of replacing changes the discharge pressure and/or flow rate of the fluid.

27. The method of claim 24 wherein two diametrically opposed slots and two diametrically opposed ports are provided through the liner.

28. The method of claim 23 further comprising forming a passage in the housing for receiving the discharged fluid from the port and passing it from the housing.

29. The method of claim 23 further comprising forming lobes on the first rotor that define screw grooves for receiving the fluid.

30. The method of claim 29 further comprising forming lobes on the second rotor so that, as the first rotor rotates, the latter lobes enter the screw grooves to trap and compress the fluid.

31. The method of claim 30 wherein, as the first rotor rotates, the trapped fluid is compressed as the length and the volume of each screw groove is reduced.

32. The method of claim 31 wherein, upon further rotation of the first rotor, each groove passes the discharge port thus delivering the compressed fluid to the drain passage.

* * * * *